United States Patent [19]

Itoh et al.

[11] Patent Number: 4,636,614

[45] Date of Patent: Jan. 13, 1987

[54] SELF-CONTROL TYPE GLOW PLUG

[75] Inventors: Tsuneo Itoh; Shinichi Yokoi, both of Aichi, Japan

[73] Assignee: NGK Spark Plug Co., Ltd., Nagoya, Japan

[21] Appl. No.: 618,875

[22] Filed: Jun. 8, 1984

[30] Foreign Application Priority Data

Jun. 13, 1983 [JP] Japan ..... 58-104199

[51] Int. Cl.[4] ..... H05B 3/00; F02P 19/02; F23Q 7/22

[52] U.S. Cl. ..... 219/270; 123/145 A; 219/544; 219/553; 361/266

[58] Field of Search ..... 219/523, 244, 260–270, 219/544, 553; 123/145 R, 145 A; 361/264, 265, 266; 338/20, 280, 210; 420/455, 441; 431/262

[56] References Cited

U.S. PATENT DOCUMENTS

| | | | |
|---|---|---|---|
| 2,030,937 | 2/1936 | Reichmann | 219/270 X |
| 2,482,551 | 9/1949 | Korsgren | 219/260 X |
| 2,667,561 | 1/1954 | Schoenwald | 338/280 X |
| 2,884,509 | 4/1959 | Heath | 338/210 X |
| 2,938,992 | 5/1960 | Crump | 219/528 |
| 4,211,204 | 7/1980 | Glauner et al. | 123/145 A |
| 4,357,526 | 11/1982 | Yamamoto et al. | 219/544 |
| 4,358,663 | 11/1982 | Sperner | 219/270 |
| 4,401,065 | 8/1983 | Minegishi et al. | 123/145 A |
| 4,423,309 | 12/1983 | Murphy et al. | 219/270 |
| 4,476,378 | 10/1984 | Takizawa et al. | 219/270 |
| 4,477,717 | 10/1984 | Walton | 219/267 |
| 4,502,430 | 3/1985 | Yokio et al. | 123/145 A |

FOREIGN PATENT DOCUMENTS

| | | | |
|---|---|---|---|
| 3003799 | 2/1980 | Fed. Rep. of Germany | 123/145 A |
| 57-26326 | 2/1982 | Japan | 219/270 |
| 58-6327 | 1/1983 | Japan | 219/270 |
| 254482 | 7/1926 | United Kingdom | 219/270 |
| 1127454 | 9/1968 | United Kingdom | 219/270 |
| 2013277 | 8/1979 | United Kingdom | 219/270 |
| 2027805 | 2/1980 | United Kingdom | 219/270 |

*Primary Examiner*—Anthony Bartis

*Attorney, Agent, or Firm*—Finnegan, Henderson, Farabow, Garrett & Dunner

[57] ABSTRACT

A rapid heating self-control type glow plug used for starting a Diesel engine, particularly, such a glow plug which is also used for regulating the cylinder or auxiliary combustion chamber temperature following starting and during normal operations of the engine. A resistor wire is connected in series with a heating wire embedded in a ceramic body. The heating wire is formed of a tungsten alloy having a temperature resistance coefficient at 1000° C. no greater than 4 times that at room temperature, while the resistor has a positive temperature resistance coefficient at 1000° C. no less than 5 times that at room temperature. Preferably, the tungsten alloy consists of tungsten and at least one of rhenium, cobalt, thorium, molybdenum and zirconium, with rhenium in an amount of 2 to 50 wt % being preferred, and rhenium in an amount of 10 to 30 wt % being the most preferable. The resistor is preferably a wire made of at least one of nickel, tungsten, molybdenum and iron.

15 Claims, 5 Drawing Figures

SELF-CONTROL TYPE GLOW PLUG

BACKGROUND OF THE INVENTION

The present invention relates to a rapid heating type glow pulg for starting a Diesel engine and, more particularly, to a self-control rapid heating type glow plug.

It has been known generally that a Diesel engine is difficult to start at low temperatures. In order to overcome this problem, it has been usual to provide a glow plug in the engine's cylinders or an auxiliary combustion chamber thereof for increasing the temperature in the cylinder or the auxiliary combustion chamber prior to starting. For this purpose, the glow plug must have a rapid heating characteristic. Recently, there has been a tendency for glow plugs to be used not only for starting but also during normal engine operation to stablize the fuel combustion in the cylinder. If a glow plug is used continuously in such a manner, the glow plug must have an improved durability.

For this purpose, a rapid heating type glow plug has been developed which is composed of a sintered ceramic body and a tungsten heating wire. Tungsten is heat durable, and thus there is little chance of thermal breakdown thereof at high temperatures. However, there is a possibility of the ceramic body being cracked by thermal shock due to rapid heating. In order to obviate the cracking problem of the ceramic body, it has been the practice to provide some auxiliary means such as a controller for controlling the current flow through the heating wire.

As another approach, a so-called self-control type glow plug has been proposed, which is composed of a ceramic body having a tungsten heating wire embedded therein and a resistor connected in series with the heating wire. The resistor, which is implemented as a wire made of a material such as nickel, tungsten or molybdenum, has a positive resistance temperature coefficient larger than that of the heating wire so that, during rapid heating, the resistance of the resistor increases rapidly to reduce the heating current and thereby prevent overheating of the heating wire. In such a self-control type glow plug, it is desired, for realization of a satisfactory self-control function, that there be a large difference in the temperature resistance coefficient of the resistor between room temperature and, for instance, 1000° C. For example, if the resistor is made of nickel for which the temperature resistance coefficient at 1000° C. is about 6 to 7 times that at room temperature, the heating wire connected in series with the resistor should have temperature resistance coefficient ratio of 4 or smaller. The term "temperature resistance coefficient ratio" herein means the ratio of the temperature resistance coefficient (change in resistance per degree change in temperature) at 1000° C. to the temperature resistance coefficient at room temperature.

A heating wire made of a material such as Fe—Cr alloy or Ni—Cr alloy can satisfy the above requirement. Metal glow plugs having such a heating wire disposed in an insulating powder filling a metal sheath have been built and tested. In such a metal glow plug, however, since the melting point of the heating wire is relatively low, it cannot withstand the sintering temperature of the ceramic material. Further, even if the heating wire could withstand such a high temperature, it cannot be successfully used with the ceramic body due to the large difference in thermal expansion coefficients therebetween.

For these reasons, tungsten heating wire has been used in conjunction with a ceramic body. The tungsten of the heating wire is of 99.9% purity or more, and accordingly the temperature resistance coefficient thereof is large. Hence, it is impossible to provide a large difference in temperature resistance coefficients between the resistor and the heating wire so that the self-control function of such a glow plug has not been sufficient.

SUMMARY OF THE INVENTION

Accordingly, an object of the present invention is to provide a ceramic glow plug which has a sufficient self-control function.

As a result of various investigations conducted by the present inventors to find heating wire materials having a sufficiently small temperature resistance coefficient, it has been found that a tungsten alloy which consists of tungsten and at least one element selected from the group consisting of rhenium, cobalt, thorium, molybdenum and zirconium is most suitable for use as the heating wire.

FIG. 1 is a graph showing the temperature resistance coefficient of the tungsten alloy containing rhenium, which is the most preferable element among those listed above, plotted against the amount of rhenium. As is clear from FIG. 1, the amount of rhenium is preferably from 2 to 50 wt %. If the amount of rhenium is less than 2 wt %, it is difficult to make the temperature resistance coefficient ratio 4 or smaller. On the other hand, if the amount of rhenium exceeds 50 wt %, the drawing of the wire becomes almost impossible. The most preferable range of the amount of rhenium is 10 to 30 wt %.

Other tungsten alloys which are preferable are those containing 5 to 30 wt % Co, 5 to 60 wt % Mo, 5 to 30 wt % Th, and 5 to 40 wt % Zr, respectively, each of which provides a temperature resistance coefficient ratio of 4 or less and a melting point of 2400° C. or higher.

The present self-control type glow plug comprises a heating wire of any of the aforementioned tungsten alloys embedded in a sintered ceramic body with a resistor connected in series with the heating wire and covered by a heat resistant insulating material. The glow plug of the present invention is completely free from the various problems inherent to the conventional glow plug.

DESCRIPTION OF THE PREFERRED EMBODIMENTS

Figure 1:
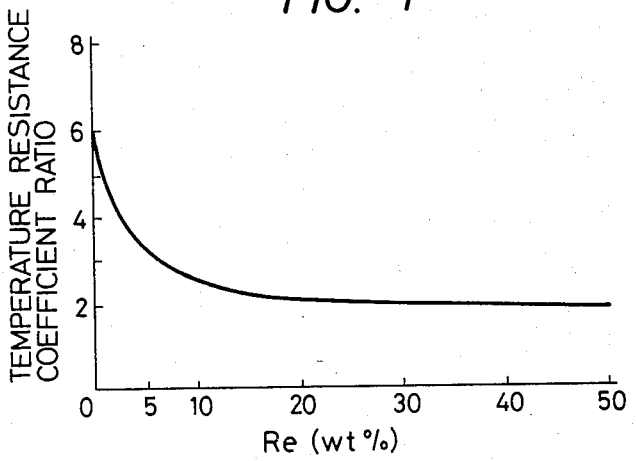
FIG. 1 is a graph showing the temperature resistance coefficient of a tungsten alloy containing rhenium plotted against the amount of the latter.
Figure 2:
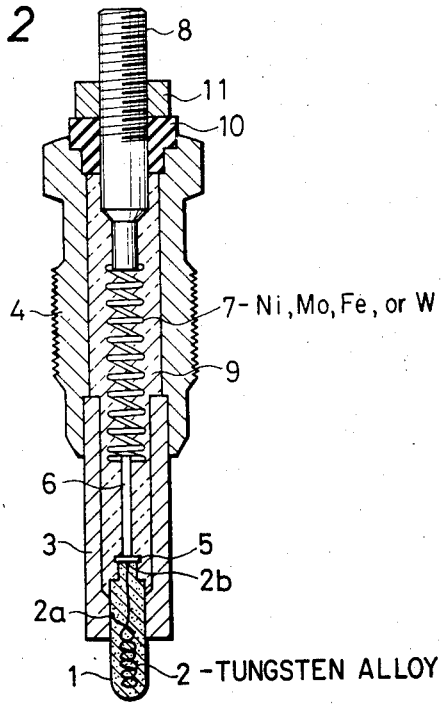
FIG. 2 shows a vertical cross section of a preferred embodiment of a glow plug of the present invention.

In FIG. 2, showing a vertical cross section of preferred embodiment of a self-control type glow plug according to the present invention, a ceramic heater 1 includes a helical wire 2 made of a tungsten alloy containing 20 wt % rhenium disposed in a sintered ceramic body composed mainly of $Si_3N_4$ and SiC, with the latter being surrounded by an outer metal sheath 3. More specifically, ceramic powder of mainly $Si_3N_4$ and SiC is preliminarily shaped to a cylindrical body with the helical wire 2 embedded therein. Then, the preliminarily sintered product is sintered using the hot press method, and thereafter the ceramic heater 1 is shaped by grinding or cutting. An upper portion of the ceramic heater 1 is soldered to an outer metal sheath 3 to which one end 2*a* of the wire 2 is connected.

The metal sheath 3 is fitted by soldering in an inner space of an end portion of a mounting shell 4 which functions as a negative electrode. The other end 2*b* of the heater wire 2 is soldered to plate member 5 fixedly secured to the rear end of the ceramic heater 1. One end of a rod 6 is welded to the cap 5. The other end of the rod 6 is connected to one end of a metal coil resistor 7 made of nickel, the other end of which is soldered to a metal center member 8.

Inner spaces of the shell 4 and the metal sheath 3 are filled with heat resistant filler 9 of, for example, MgO or glass to hold the various members (5, 6, 7 and 8). A nut 11 holds the insulator 10 to the center member 8, which functions as a positive electrode.

The tungsten alloy wire 2 of the ceramic heater 1 preferably contains 10 to 30 wt % rhenium. Tungsten alloy containing rhenium in an amount of 10 to 30 wt % provides a very small temperature resistance coefficient ratio of 2 to 4. Further, since the resistor 7 connected in series with the heater wire 2 is made of Ni, which material has a positive temperature resistance coefficient ratio of about 6 to 7, the resistance value of the resistor 7 increases more rapidly than that of the heater wire 2 when a heating current flows through the wire 2, and, therefore, the heating current is automatically reduced. Consequently, overheating of the wire 2 is effectively prevented.

The material of the resistor 7 should have a temperature resistance coefficient ratio larger than 5. Tungsten (having a ratio of 5 to 6), molybdenum (having a ratio of 5 to 6), or iron (having a ratio of 10 to 11) may be used for this purpose.

Figure 3:
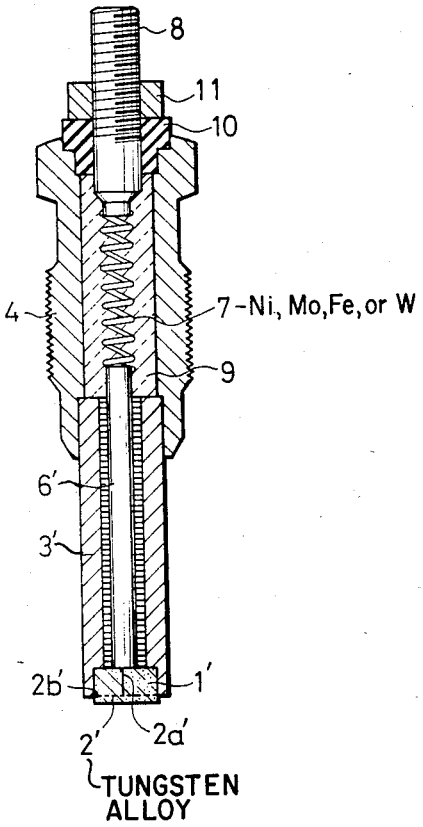
FIG. 3 shows a vertical cross section of another embodiment of the present invention.
Figure 4A:
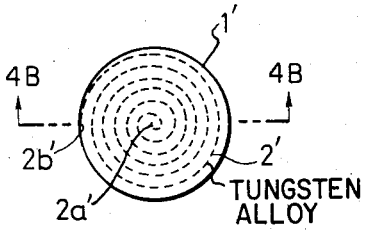
FIG. 4A depicts a cross section of a ceramic heater portion of the glow plug shown in FIG. 3.
Figure 4B:
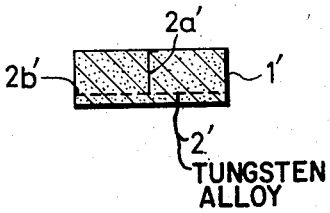
FIG. 4B is a cross-sectional view taken along a line 4B—4B in FIG. 4A.

FIG. 3 shows a vertical cross section of another embodiment a glow plug of the present invention, in which components the same as those in FIG. 2 are identified by like reference numerals. In FIG. 3, a ceramic heater 1' takes the form of disc and a heating wire 2' takes the form of spiral. The configurations of these members are shown in detail in FIGS. 4A and 4B. A metal rod 6' is disposed in a metal sheath 3' and directly connected to the rear portion of the ceramic heater 1', to which one end 2*a'* of the heater wire 2' is connected. The other end 2*b'* of the heater wire 2' is connected to the metal sheath 3'.

As described hereinbefore, the self-control type glow plug according to the present invention is featured by a heating wire of a tungsten alloy containing at least one element selected from the group consisting of rhenium, cobalt, thorium, molybdenum and zirconium, which has a temperature resistance coefficient ratio of 4 or less, and which is embedded in a sintered ceramic body. A resistor is connected in series with the heating wire which has a positive temperature resistance coefficient ratio of 5 or more. With such a combination of heating wire and series resistor, the resistance value of the series resistor increases more rapidly than that of the heating wire when a current flows therethrough, and therefore the current is reduced to prevent overheating of the heating wire. Thus, sufficient self-control of the temperature of the heating wire is achieved without the use of complicated and expensive expedients.

We claim:

1. A self-control type glow plug for use in an engine, the plug comprising:

means including a shell member for mounting said glow plug to the engine;

heat generating means comprised of a sintered ceramic body and a heating wire embedded therein, said heating wire having terminal ends located outside said ceramic body for establishing electrical connections, said ceramic body being connected to extend from said shell member, and said heating wire consisting essentially of a tungsten alloy having a temperature resistance coefficient at 1000° C. no greater than four times that at room temperature; and a current control resistor electrically connected in series with said heating wire of said heat generating means for controlling the temperature of said heat generating means, said resistor comprising a wire having a positive temperature resistance coefficient at 1000° C. no less than five times that at room temperature, wherein said heating wire consists essentially of tungsten alloyed with 2 to 50 wt % rhenium.

2. The self-control type glow plug as claimed in claim 1, wherein said wire of said resistor consists essentially of at least one material selected from the group consisting of nickel, tungsten, molybdenum and iron.

3. A self-control type glow plug as claimed in claim 1 wherein said heating wire is coiled within said ceramic body relative to the longitudinal axis thereof.

4. A self-control type glow plug for use in an engine, the plug comprising:

means including a shell member for mounting said glow plug to the engine;

heat generating means comprised of a sintered ceramic body and a heating wire embedded therein, said heating wire having terminal ends located outside said ceramic body for establishing electrical connections, said ceramic body being connected to extend from said shell member, and said heating wire consisting essentially of a tungsten alloy having a temperature resistance coefficient at 1000° C. no greater than four times that at room temperature; and a current control resistor electrically connected in series with said heating wire of said heat generating means for controlling the temperature of said heat generating means, said resistor comprising a wire having a positive temperature resistance coefficient at 1000° C. no less than five times that at room temperature, wherein said heating wire consists essentially of tungsten alloyed with 10 to 30 wt % rhenium.

5. The self-control type glow plug as claimed in claim 4, wherein said wire of said resistor consists essentially of at least one material selected from the group consisting of nickel, tungsten, molybedenum and iron.

6. A self-control type glow plug as claimed in claim 4 wherein said heating wire is coiled within said ceramic body relative to the longitudinal axis thereof.

7. A self-control type glow plug for use in an engine, the plug comprising:

means including a shell member for mounting said glow plug to the engine;

heat generating means comprised of a sintered ceramic body and a heating wire embedded therein, said heating wire having terminal ends located outside said ceramic body for establishing electrical connections, said ceramic body being connected to extend from said shell member, and said heating wire consisting essentially of tungsten alloyed with about 5 to 30 wt % cobalt and having a temperature resistance coefficient at 1000° C. no greater than four times that at room temperature; and a current control resistor electrically connected in series with said heating wire of said heat generating means for controlling the temperature of said heat generating means, said resistor being positioned within said shell member and apart form said ceramic body, said resistor comprising a wire having a positive temperature resistance coefficient at 1000° C. no less than five times that at room temperature.

8. The self-control type glow plug as claimed in claim 7, wherein said wire of said resistor consists essentially of at least one material selected from the group consisting of nickel, tungsten, molybdenum and iron.

9. The self-control type glow plug as claimed in claim 7, wherein said heating wire is coiled within said ceramic body relative to the longitudinal axis thereof.

10. A self-control type glow plug for use in an engine, the plug comprising:

means including a shell member for mounting said glow plug to the engine;

heat generating means comprised of a sintered ceramic body and a heating wire embedded therein, said heating wire having terminal ends located outside said ceramic body for establishing electrical connections, said ceramic body being connected to extend from said shell member, and said heating wire consisting essentially of tungsten alloyed with about 5 to 30 wt % thorium and having a temperature resistance coefficient at 1000° C. no greater than four times that at room temperature; and a current control resistor electrically connected in series with said heating wire of said heat generating means for controlling the temperature of said heat generating means, said resistor being positioned within said shell member and apart from said ceramic body, said resistor comprising a wire having a positive temperature resistance coefficient at 1000° C. no less than five times that at room temperature.

11. A self-control type glow plug as claimed in claim 10, wherein said wire of said resistor consists essentially of at least one material selected from the group consisting of nickel, tungsten, molybdenum and iron.

12. A self-control type glow plug as claimed in claim 10 wherein said heating wire is coiled within said ceramic body relative to the longitudinal axis thereof.

13. A self-control type glow plug for use in an engine, the plug comprising:

means including a shell member for mounting said glow plug to the engine;

heat generating means comprised of a sintered ceramic body and a heating wire embedded therein, said heating wire having terminal ends located outside said ceramic body for establishing electrical connections, said ceramic body being connected to extend from said shell member, and said heating wire consisting essentially of tungsten alloyed with about 5 to 40 wt % zirconium and having a temperature resistance coefficient at 1000° C. no greater than four times that at room temperature; and a current control resistor electrically connected in series with said heating wire of said heat generating means for controlling the temperature of said heat generating means, said resistor being positioned within said shell member and apart from said ceramic body, said resistor comprising a wire having a positive temperature resistance coefficient at 1000° C. no less than five times that at room temperature.

14. A self-control type glow plug as claimed in claim 13, wherein said wire of said resistor consists essentially of at least one material selected from the group consisting of nickel, tungsten, molybdenum and iron.

15. A self-control type glow plug as claimed in claim 13 wherein said heating wire is coiled within said ceramic body relative to the longitudinal axis thereof.

* * * * *